US009745853B2

(12) United States Patent
Lee et al.

(10) Patent No.: US 9,745,853 B2
(45) Date of Patent: Aug. 29, 2017

(54) INTEGRATED CIRCUIT COOLED TURBINE BLADE

(71) Applicant: Siemens Energy, Inc., Orlando, FL (US)

(72) Inventors: Ching-Pang Lee, Cincinnati, OH (US); Nan Jiang, Charlotte, NC (US); Jae Y. Um, Winter Garden, FL (US); Harry Holloman, Cincinnati, OH (US); Steven Koester, Sharonville, OH (US)

(73) Assignee: SIEMENS ENERGY, INC., Orlando, FL (US)

( * ) Notice: Subject to any disclaimer, the term of this patent is extended or adjusted under 35 U.S.C. 154(b) by 79 days.

(21) Appl. No.: 14/840,572

(22) Filed: Aug. 31, 2015

(65) Prior Publication Data

US 2017/0058678 A1 Mar. 2, 2017

(51) Int. Cl.
*F01D 5/18* (2006.01)
*F01D 5/14* (2006.01)

(52) U.S. Cl.
CPC ..... *F01D 5/187* (2013.01); *F01D 5/147* (2013.01); *F05D 2220/32* (2013.01); *F05D 2240/303* (2013.01); *F05D 2240/304* (2013.01); *F05D 2260/202* (2013.01); *F05D 2260/2212* (2013.01)

(58) Field of Classification Search
CPC ..... F01D 5/187; F01D 5/18; F05D 2220/32; F05D 2240/303; F05D 2240/304; F05D 2260/202; F05D 2260/2212; F05D 2260/22141; F05D 2250/314; Y02T 50/676
See application file for complete search history.

(56) References Cited

U.S. PATENT DOCUMENTS 4,753,575 A * 6/1988 Levengood ..... F01D 5/187 415/115
7,950,903 B1 * 5/2011 Liang ..... F01D 5/186 415/115
8,043,059 B1 * 10/2011 Liang ..... F01D 5/187 416/96 R
8,066,483 B1 * 11/2011 Liang ..... F01D 5/187 416/241 B
2003/0026698 A1 * 2/2003 Flodman ..... F01D 5/186 416/97 R
2006/0153678 A1 * 7/2006 Liang ..... F01D 5/187 416/97 R
2010/0170667 A1 * 7/2010 Bertolotti ..... F28F 1/124 165/166

(Continued)

*Primary Examiner* — Dwayne J White
*Assistant Examiner* — Justin Pruitt

(57) ABSTRACT

A turbine rotor blade includes at least two integrated cooling circuits that are formed within the blade that include a leading edge circuit having a first cavity and a second cavity and a trailing edge circuit that includes at least a third cavity located aft of the second cavity. The trailing edge circuit flows aft with at least two substantially 180-degree turns at the tip end and the root end of the blade providing at least a penultimate cavity and a last cavity. The last cavity is located along a trailing edge of the blade. A tip axial cooling channel connects to the first cavity of the leading edge circuit and the penultimate cavity of the trailing edge circuit. At least one crossover hole connects the penultimate cavity to the last cavity substantially near the tip end of the blade.

19 Claims, 5 Drawing Sheets

(56) References Cited

U.S. PATENT DOCUMENTS

| | | | | |
|---|---|---|---|---|
| 2015/0040582 | A1* | 2/2015 | Dong | F01D 5/187<br>60/806 |
| 2016/0108740 | A1* | 4/2016 | Srinivasan | F01D 5/188<br>60/806 |
| 2016/0319671 | A1* | 11/2016 | Benson | F01D 5/18 |

* cited by examiner

INTEGRATED CIRCUIT COOLED TURBINE BLADE

STATEMENT REGARDING FEDERALLY SPONSORED RESEARCH

Development of this invention was supported in part by the United States Department of Energy, Contract No. DE-FC26-05NT42644. Accordingly, the United States Government may have certain rights in this invention.

BACKGROUND

1. Field

The present invention relates to gas turbine engines, and more specifically to a turbine blade with multiple internal cooling air circuits.

2. Description of the Related Art

In an industrial gas turbine engine, hot compressed gas is produced. The hot gas flow is passed through a turbine and expands to produce mechanical work used to drive an electric generator for power production. The turbine generally includes multiple stages of stator vanes and rotor blades to convert the energy from the hot gas flow into mechanical energy that drives the rotor shaft of the engine. Turbine inlet temperature is limited to the material properties and cooling capabilities of the turbine parts. This is especially important for first stages of turbine vanes and blades since these airfoils are exposed to the hottest gas flow in the system.

A combustion system receives air from a compressor and raises it to a high energy level by mixing in fuel and burning the mixture, after which products of the combustor are expanded through the turbine.

Since the turbine blades are exposed to the hot gas flow discharged from combustors within the combustion system, cooling methods are used to obtain a useful design life cycle for the turbine blade. Blade cooling is accomplished by extracting a portion of the cooler compressed air from the compressor and directing it to the turbine section, thereby bypassing the combustors. After introduction into the turbine section, this cooling air flows through passages or channels formed in the airfoil portions of the blades. The blade tip and the trailing edge of the blade are the most challenging locations in cooling.

The turbine second row blade is typically larger than the first row blade and has more surface area to cool. The second row blade is exposed to a lower gas temperature than the first row blade and therefore needs to allow for the use of less amounts of cooling air for better turbine efficiency.

In order to allow for higher temperatures, turbine blade designers have proposed several complex internal blade cooling circuits to maximize the blade cooling through the use of convection cooling, impingement cooling and film cooling of the blades. Conventionally, the focus of cooling improvement has been with the first row blade for more impact to turbine efficiency.

FIGS. 1 and 2 show a prior art turbine blade with two cooling circuit designs. The cooling circuit designs include a forward and an aft circuits. The forward blade cooling circuit includes a channel that exits to an axial tip cooling channel. The aft blade cooling circuit includes a first pass cooling channel, a second pass cooling channel, and a third pass cooling channel. The cooling circuit flow from the mid-chord aft ward towards a trailing edge of the blade.

FIGS. 1 and 2 show a turbine blade with two cooling circuits. The leading edge circuit enters from the leading edge and flowing aft with a 90 degree turn at the tip and exits the blade through a tip axial cooling channel. The trailing edge circuit enters from the mid-chord and flowing aft with two 180 degree turns at the tip and the root and exits through trailing edge pin banks and trailing edge exit holes. The third leg or pass cooling channel of the trailing edge circuit may include a row of exit cooling holes or slots to discharge the cooling air from the serpentine flow circuits axially out from the blade.

While this design provides good cooling to the majority of the airfoil, the blade tip section is much hotter than the other portions of the airfoil.

SUMMARY

In one aspect of the present invention, a turbine rotor blade comprises: a leading edge and a trailing edge joined by a pressure side and a suction side, a tip end, and a root end; at least two integrated cooling circuits formed within the blade to provide cooling for the blade comprising; a leading edge circuit comprising a first cavity located along the leading edge of the blade and a second cavity positioned aft of the first cavity in an axial direction, wherein the second cavity opens forward into the first cavity; a trailing edge circuit comprising at least a third cavity located in a mid-chord area of the blade aft of the second cavity, wherein the trailing edge circuit flows aft with at least two substantially 180-degree turns at the tip end and the root end of the blade providing at least a penultimate cavity and a last cavity, wherein the last cavity is located along a trailing edge of the blade; and a tip axial cooling channel comprising a first opening and a second opening, wherein the first opening connects to the first cavity and the second opening connects to the penultimate cavity, wherein the tip axial cooling channel connects the leading edge circuit to the trailing edge circuit, integrating the at least two cooling circuits; and at least one crossover hole connecting the penultimate cavity to the last cavity substantially near the tip end of the blade.

In another aspect of the present invention, a method for increasing cooling to a trailing edge tip corner of a turbine blade, comprises: providing a tip axial cooling channel comprising a first opening and a second opening, connecting the first opening of the tip axial cooling channel to an end of a first cavity of a leading edge circuit of at least two integrated cooling circuits formed within the turbine blade, wherein the leading edge circuit comprises a first cavity located along a leading edge of the blade and a second cavity positioned aft of the first cavity in an axial direction, wherein the second cavity opens forward into the first cavity; connecting the second opening of the tip axial cooling channel to a trailing edge circuit, wherein the trailing edge circuit comprises at least a third cavity located in a mid-chord area of the blade aft of the second cavity, wherein the trailing edge circuit flows aft with at least two substantially 180-degree turns at the tip end and the root end of the blade providing at least a penultimate cavity and a last cavity, wherein the last cavity is located along a trailing edge of the blade, wherein the at least two integrated cooling circuits further comprise at least one crossover hole connecting the penultimate cavity to the last cavity substantially near the tip end of the blade; sending cooling air through the second cavity of the leading edge circuit and the third cavity of the trailing edge circuit, wherein the cooling air flowing through the leading edge circuit then flows through the tip axial cooling channel and into the penultimate cavity of the trailing edge circuit, merging with the cooling air entering into the penultimate cavity in the trailing edge circuit, wherein a portion of the cooling air flows through the at least one crossover hole into the trailing edge tip corner, and a portion of the cooling air flows through the rest of the penultimate cavity into and up through the last cavity through the rest of the trailing edge circuit into the trailing edge tip corner and/or out through the trailing edge of the turbine blade.

These and other features, aspects and advantages of the present invention will become better understood with reference to the following drawings, description and claims.

BRIEF DESCRIPTION OF THE DRAWINGS

The invention is shown in more detail by help of figures. The figures show preferred configurations and do not limit the scope of the invention.

DETAILED DESCRIPTION

Figure 2:
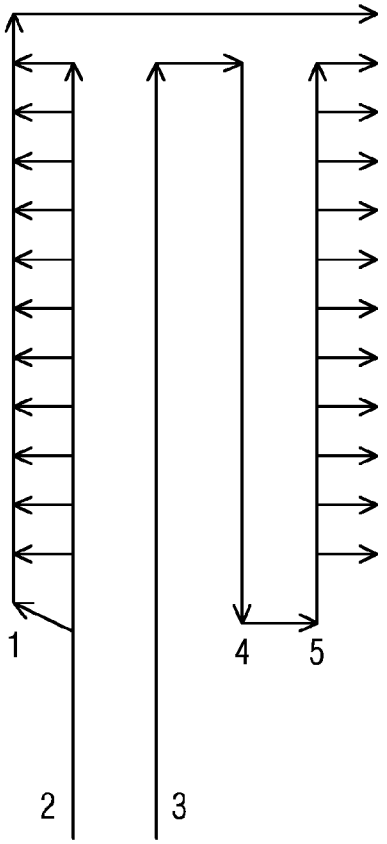
FIG 2 PRIOR ART
FIG. 2 is a diagram of a prior art turbine blade with two cooling circuits showing flow paths.
Figure 1:
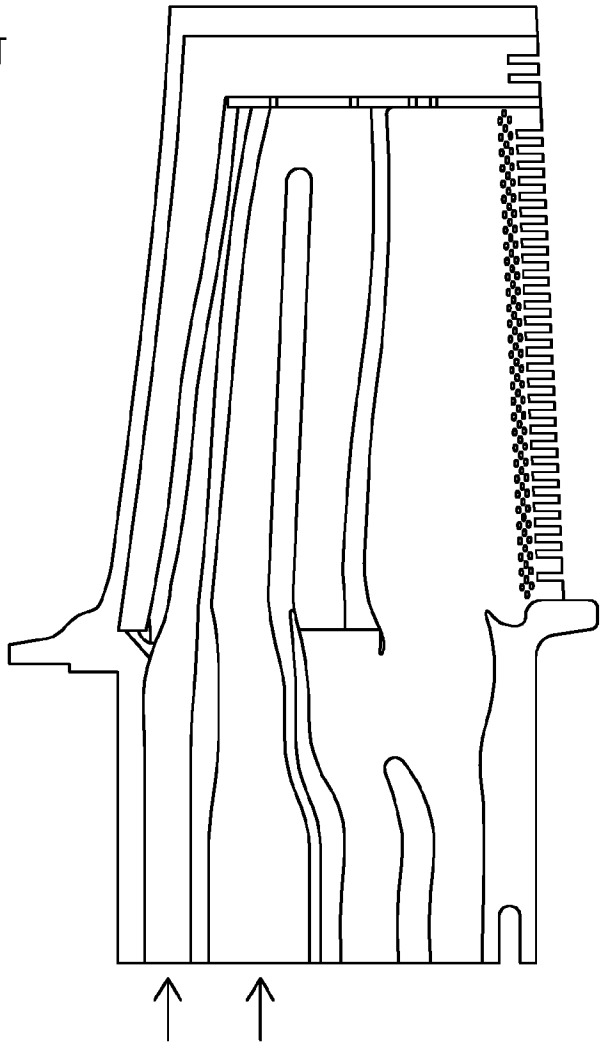
FIG 1 PRIOR ART
FIG. 1 is a cross sectional view looking from the pressure side of a prior art turbine blade with two cooling circuits.
Figure 3:
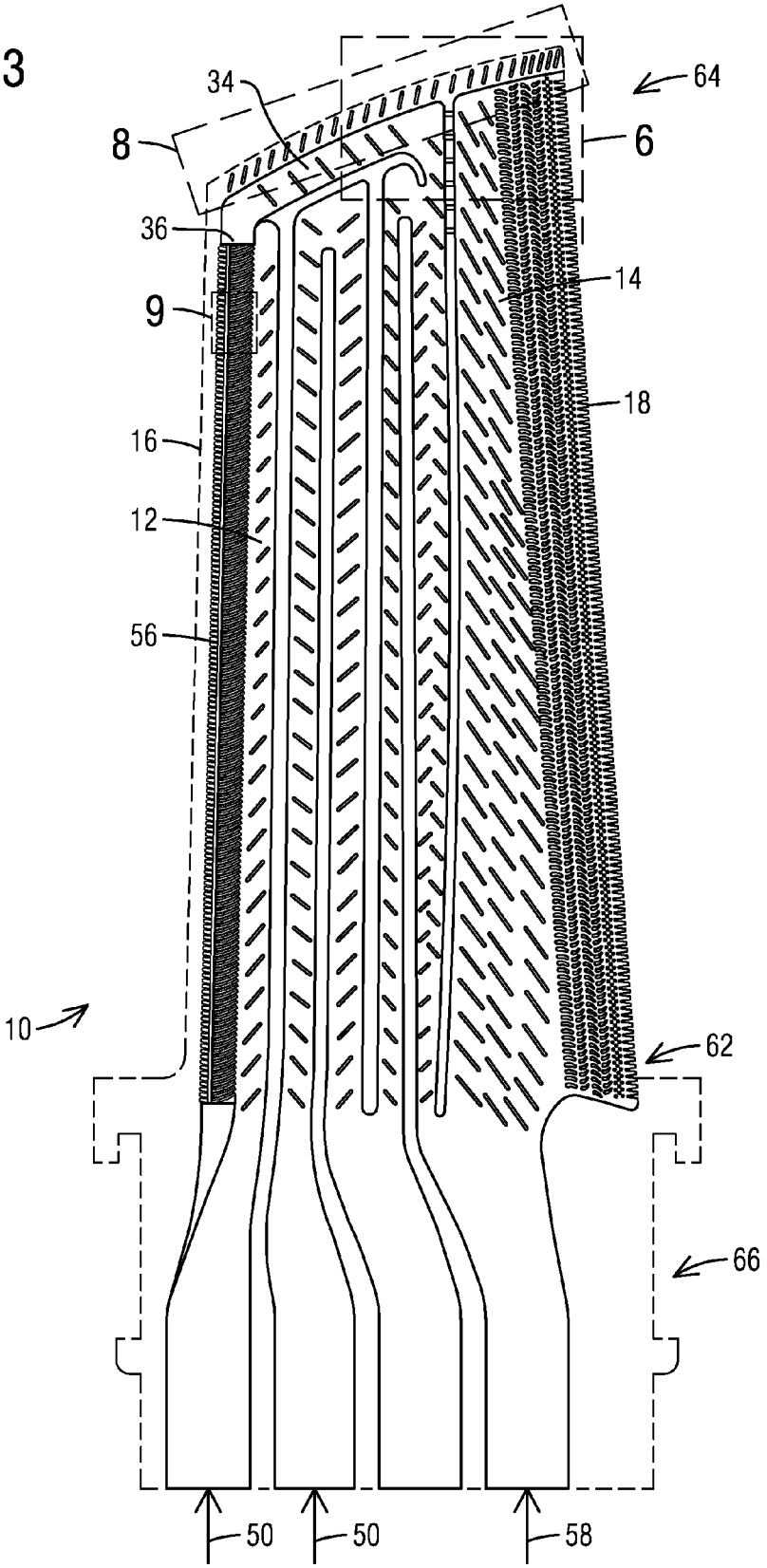
FIG. 3 is a cross sectional view looking from the pressure side of an exemplary embodiment of the present invention.
Figure 4:
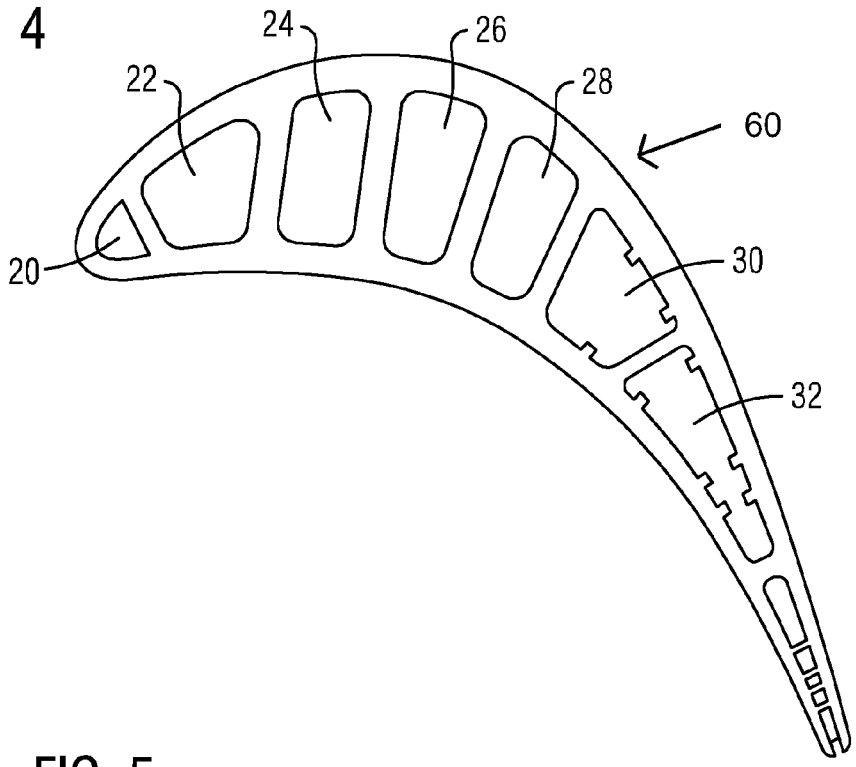
FIG. 4 is cross sectional top view of a blade airfoil of an exemplary embodiment of the present invention.
Figure 5:
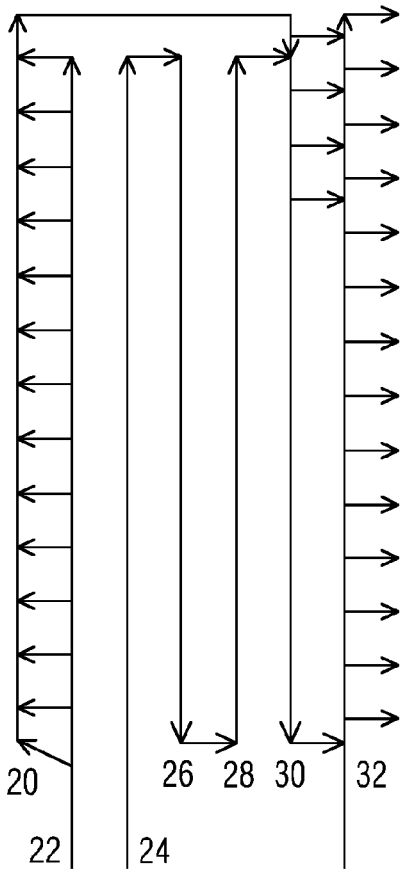
FIG. 5 is a diagram of a turbine blade with two cooling circuits showing flow paths of an exemplary embodiment of the present invention.

Broadly, an embodiment of the present invention provides a turbine rotor blade that includes at least two integrated cooling circuits that are formed within the blade that include a leading edge circuit having a first cavity and a second cavity and a trailing edge circuit that includes at least a third cavity located aft of the second cavity. The trailing edge circuit flows aft with at least two substantially 180-degree turns at the tip end and the root end of the blade providing at least a penultimate cavity and a last cavity. The last cavity is located along a trailing edge of the blade. A tip axial cooling channel connects to the first cavity of the leading edge circuit and the penultimate cavity of the trailing edge circuit. At least one crossover hole connects the penultimate cavity to the last cavity substantially near the tip end of the blade.

A blade of a gas turbine receives high temperature gases from a combustion system in order to produce mechanical work of a shaft rotation. Due to the high temperature gases, a cooling system may be provided to reduce the temperature levels throughout the blade.

A gas turbine cooling system may perform two basic functions. The first function may be to provide direct cooling of components exposed to gas path temperature that is higher than material temperature limits. The second function may be that of turbine environmental control. Air at correct pressure and temperature may be provided at various critical points to ensure that design environment is maintained throughout the turbine.

In certain embodiments, air for cooling the rotor and rotating blades may be extracted from the axial compressor discharge at a combustor shell. The compressor discharge air may pass through an air-to-air cooler and may be filtered for rotor cooling. Direct cooling may occur at the turbine spindle blade root end along one or more stages. The turbine stationary vanes may be cooled by both internal bypassing and external bleeding lines.

An effective step that can be taken to increase the power output and improve the efficiency of a gas turbine engine may be to increase the temperature at which heat is added to the system, that is, to raise the turbine inlet temperature of the combustion gases directed to the turbine. Increases in efficient turbines have lead to an increase in the temperature that must be withstood by the turbine blades and rotor. The result is that to use the highest desirable temperatures, some form of forced cooling may be desirable. This cooling may be in the form of air bled from the compressor at various stages, and ducted to critical elements in the turbine. Although emphasis is placed on cooling the initial stages of vanes and blades, air may be also directed to other vanes, blade rings and discs.

Being furthest from the inlet of cooling air, a trailing edge corner of the blade tends to be the one of the hottest portions of the blade after cooling. Better cooling to a tip section of a blade without using additional cooling air may be desirable. Embodiments of the present invention provide a blade that may allow for the reduction in temperature of the tip section of the blade without the use of additional cooling air. The cooling air that may be provided can stay within the turbine providing cooling for as long as possible.

The blades may be set in rows. A first row blade may receive the highest temperatures. A second row blade may receive reduced temperatures from the first row blade and may have a larger surface area. Due to the lower temperatures and larger surface area, efficiency may be based on a reduced amount of air being used for the second row blade.

As is illustrated in FIGS. 3 through 9, a turbine rotor blade 10, includes a pressure side (not shown), and suction side 60, a leading edge 16 and a trailing edge 18. The leading edge and the trailing edge of the blade 10 joined by the pressure side and the suction side of the blade 10. The blade 10 may also include a platform 66. The blade 10 may also be referred to as an airfoil. The turbine rotor blade 10 may include at least two cooling circuits, a leading edge circuit 12 and a trailing edge circuit 14. Each cooling circuit may include separate entrances to form at least two cooling air streams. The leading edge circuit 12 may include a first cavity 20 and a second cavity 22. The entrance to the leading edge circuit 12 may pass through the second cavity 22. Cooling air 50 may enter into the second cavity 22 and impinge into the first cavity 20 to form a helical flow along a radial direction and turn into a tip axial cooling channel 34.

The trailing edge circuit 14 may include a serpentine style path that may include multiple pass cooling channels, also referred to as cavities. In certain embodiments, there is a 3-pass serpentine cooling circuit. In certain embodiments, there is a 5-pass serpentine cooling circuit. In certain embodiments, there is a 7-pass serpentine cooling circuit. The trailing edge circuit 14 may include a third cavity 24. The entrance to the trailing edge circuit 14 may pass through the third cavity 24. The trailing edge circuit 14 may also include at least a penultimate cavity 30 and a last cavity 32. The trailing edge circuit 14 may include a third to last cavity 28. Below is described a 5-pass serpentine cooling circuit with the third to last cavity represented by the fifth cavity 28, the penultimate cavity represented by a sixth cavity 30 and the last cavity represented by a seventh cavity 32; however, in differently numbered cooling circuit the third to last cavity 28, the penultimate cavity 30, and the last cavity 32 may be different numbered cavities based on the total amount of passes within the serpentine cooling circuit.

In certain embodiments, the trailing edge circuit 14 may include, besides the third cavity 24, a fourth cavity 26, the fifth cavity 28, the sixth cavity 30, and the seventh cavity 32. The third cavity 24 may be in the radial direction towards a tip end 64 of the blade 10. The fourth cavity 26 may be in the radial direction towards a root end 62 of the blade 10. The fifth cavity 28 may be in the radial direction towards the tip end 64 of the blade 10. The sixth cavity 30 may be in the radial direction towards the root end 62 of the blade 10. The seventh cavity 32 may start in the radial direction towards the tip end 64 of the blade 10. The multiple pass cooling channels help move flow of air 50 from the leading edge 16 to the trailing edge 18 in order to help reduce the blade temperature throughout the blade 10.

The multiple cooling channels or cavities of the trailing edge circuit 14 are connected through substantially 180-degree turns along the tip end 64 and the root end 62 of the blade airfoil 10 that change the direction of cooling air flow 50 through the multiple cavities as the air flow 50 moves aft. The leading edge circuit 12 may include the first cavity 20 located along the leading edge 16 of the blade 10. The second cavity 22 is positioned aft of the first cavity 20 and may open forward into the first cavity 20. The trailing edge circuit 14 may include the third cavity 24 located in an approximately mid-chord area 68 of the blade 10 aft of the second cavity 22. The trailing edge circuit 14 may then flow aft with at least two substantially 180-degree turns at the tip end 64 and the root end 62 of the blade 10 providing the penultimate cavity 30 and the last cavity 32. The last cavity 32 may be located along the trailing edge 18 of the blade 10.

A tip axial cooling channel 34 may include a first opening 36 and a second opening 38. The tip axial cooling channel 34 may connect the leading edge circuit 12 to the trailing edge circuit 14, integrating the at least two cooling circuits. In certain embodiments, the trailing edge circuit 14 may be positioned below the tip axial cooling channel 34. The cooling air 50 flowing through the first cavity of the leading edge circuit 12 may then flow through the first opening 36 of the tip axial cooling channel 34 and into the tip axial cooling channel 34. Cooling air 50 may also flow through the trailing edge circuit 14 starting by entering the third cavity 24 and moving aft through the trailing edge circuit 14. The air flow 50 may then pass through the tip axial cooling channel 34 second opening 38 into the penultimate cavity 30, or the sixth cavity in a 5-pass serpentine cooling circuit. The cooling air flow 50 from the tip axial cooling channel 34 may then merge with the air flow 50 from the fifth cavity 28 in the trailing edge circuit 14. This merging of air flow 50 may occur near a trailing edge tip corner 42. The cooling air 50 merging near the trailing edge tip corner 42 may decrease the temperature in that particular area without the need for additional cooling air.

The seventh cavity 32 of the trailing edge circuit 14 may open axially aft ward towards and through the trailing edge 18 of the blade 10. In certain embodiments, a plurality of trailing edge pins 44 and/or trailing edge exit holes 46 may be aligned along the trailing edge 18 allowing for the cooling air flow 50 to exit aft ward along the trailing edge 18 of the blade 10 and out of the blade 10. The trailing edge pins 44 and/or trailing edge exit holes 46 may promote heat transfer.

Further, at least one crossover hole 40 may connect the sixth cavity 30 and the seventh cavity 32. The at least one crossover hole 40 may be positioned substantially near the tip end 64 of the blade 10. The at least one crossover hole 40 may bring more cooling air 50 to the trailing edge tip corner 42. In certain embodiments, the at least one crossover hole 40 may have an elliptical shape.

The temperature of the blade 10 increases near the end of the trailing edge circuit 14 and along the tip end 64 along the leading edge 16 of the blade 10. Allowing additional cooling air 50 to enter the trailing edge tip corner 42 area through the tip axial cooling channel 34 and through the plurality of crossover holes 40, the temperature of the trailing edge tip corner 42 may decrease. A decrease in temperature may increase the life of the component and may provide increase efficiency.

Figure 6:
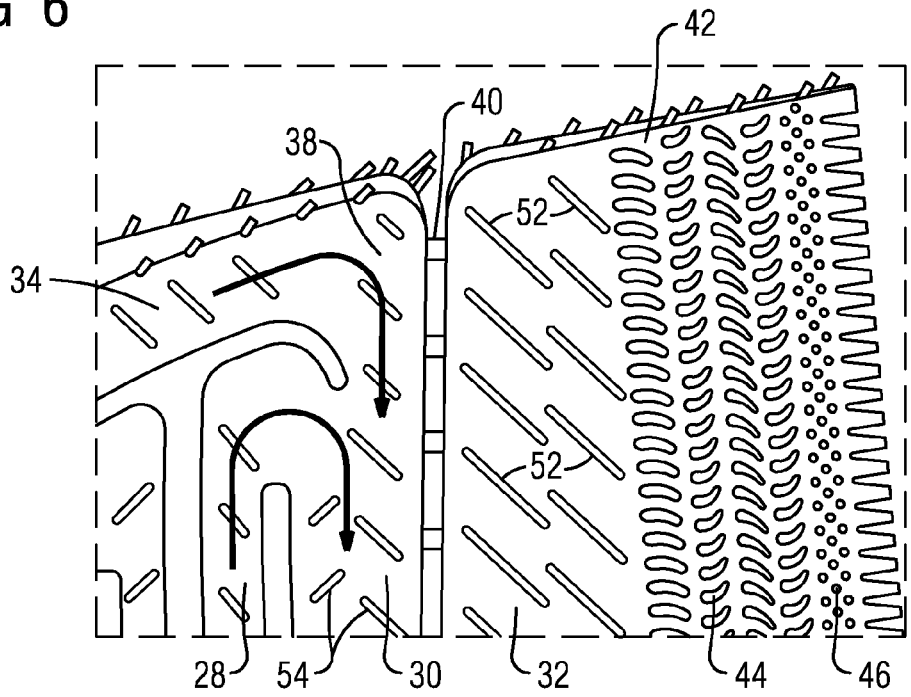
FIG. 6 is a detailed cross sectional suction side view of an integration of cooling circuits of an exemplary embodiment of the present invention.
Figure 7:
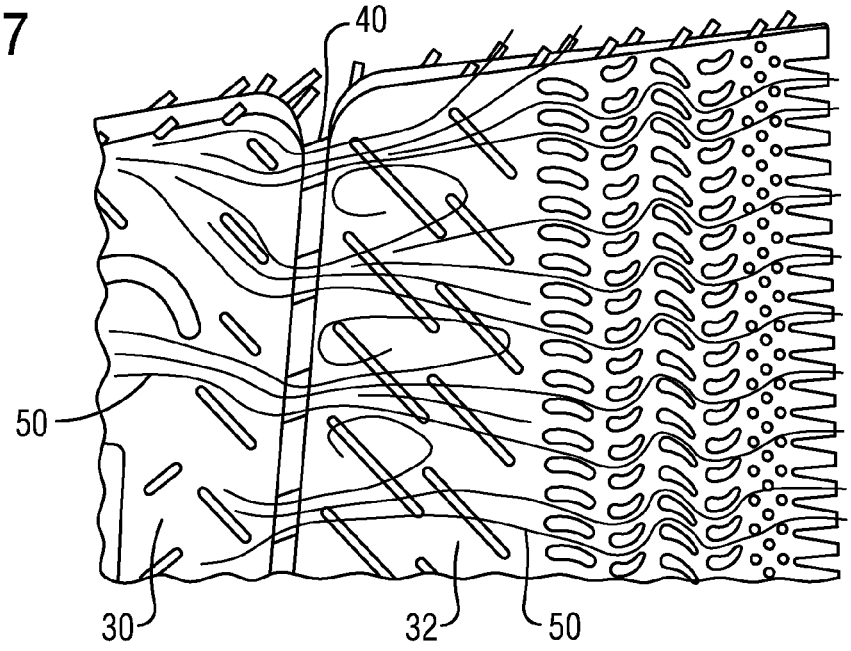
FIG. 7 is a detailed view of flow paths through the integrated cooling circuits of an exemplary embodiment of the present invention.
Figure 8:
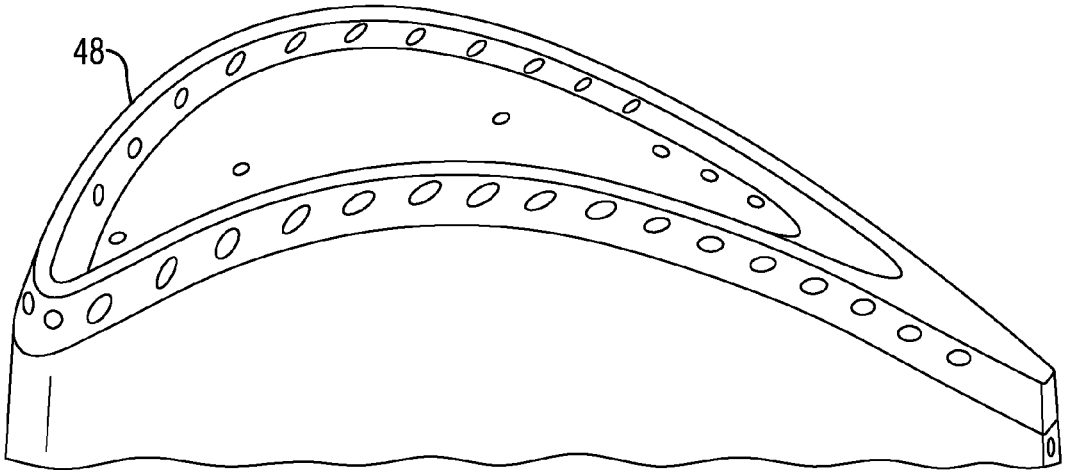
FIG. 8 is a perspective top view of an inboard squealer tip of an exemplary embodiment of the present invention.
Figure 9:
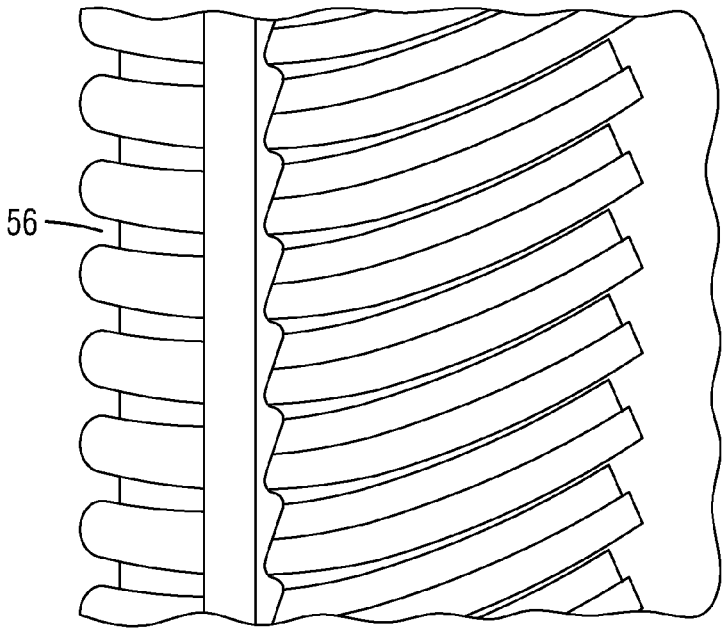
FIG. 9 is a detailed leading edge view of helical mini grooves of an exemplary embodiment of the present invention.

FIG. 6 shows the path of the cooling air 50 through the tip axial cooling channel 34 into the sixth cavity 30 and partially through the plurality of crossover holes 40 in further detail. Cooling air flow 50 from the third to last cavity 28 of the trailing edge circuit 14 entering into the sixth cavity 30 of the trailing edge circuit 14 is also shown as well partially flowing into the seventh cavity 32 through the at least one cross over hole 40. FIG. 7 shows the details of the air flow 50 through the paths created through the cooling circuits. The first opening 36 of the tip axial cooling channel 34 may connect to the first cavity of the leading edge circuit 12. A substantially 90-degree turn from the leading edge circuit 12 to the tip axial cooling channel 34 may move the cooling air 50 flowing through the leading edge circuit 12 aft towards the trailing edge 18 of the blade 10.

The second opening 38 of the tip axial cooling channel 34 may connect with the penultimate cavity 30 in the trailing edge circuit 14. In certain embodiments, the tip axial cooling channel 34 may connect through the sixth cavity 30 of the trailing edge circuit 14. The cooling air 50 may then flow through the plurality of crossover holes 40 into the seventh cavity 32 along the trailing edge 18.

In certain embodiments, the trailing edge 18 may include zigzag pins and exit slots as detailed in FIG. 6. The zigzag pins may have an airfoil shape that helps aerodynamically move the flow of gas through the trailing edge 18.

An inboard squealer tip 48 may be used in certain embodiments. The inboard squealer locates the squealer directly on the top of a tip cap of the tip end of the blade 10 to receive more effective conduction cooling.

In certain embodiments, refresher air 58 may be added to the airfoil 10. The refresher air 58 may be added through the seventh cavity 32. The refresher air 58 is not required, however the system may benefit by the use of the refresher air 58.

In certain embodiments, turbulators may be added to the body of the airfoil 10. Conventionally, full continuous turbulators may be used along the cavities. In certain embodiments, broken and offset turbulators 52 may cover the trailing edge 18. The pattern of broken and offset turbulators 52 may increase the flow of cooling air 50 radially upward along the cavity in order to provide additional cooling towards the tip end 64 of the blade 10. Upstream of the trailing edge 18, broken and staggered turbulators 54 may be used to cover the various channels.

In certain embodiments, the first cavity may include helical mini-grooves 56 along the leading edge 16. The helical mini-grooves 56 may increase the flow radially upward towards the tip axial cooling channel 34.

A method for increasing cooling to a trailing edge tip corner 42 may include providing the tip axial cooling channel 34 and connecting the first opening 36 of the tip axial cooling channel 34 to an end of the first cavity 20 of the leading edge circuit 12 of at least two integrated cooling circuits formed within the blade 10. The leading edge circuit 12 may include the first cavity 20 located along the leading edge 16 of the blade 10 and the second cavity 22 positioned aft of the first cavity 20 in an axial direction. The second cavity 22 may open forward into the first cavity 20. The second opening 38 of the tip axial cooling channel 34 may be connected to the trailing edge circuit 14 through the sixth cavity 30 of the trailing edge circuit 14.

The trailing edge circuit 14 may include at least a third cavity 24 located in a mid-chord area of the blade 10 aft of the second cavity 22. The trailing edge circuit 14 may flow aft with at least two substantially 180-degree turns at the tip end 64 and the root end 62 of the blade 10 providing at least the penultimate cavity 30 and the last cavity 32. The last cavity 32 may be located along the trailing edge 18 of the blade 10. The at least two integrated cooling circuits may further include at least one crossover hole 40 connecting the penultimate cavity 30 to the last cavity 32 substantially near the tip end 64 of the blade 10.

Cooling air 50 may be sent through the second cavity 22 of the leading edge circuit 12 and the third cavity 24 of the trailing edge circuit 14. The cooling air 50 flowing through the leading edge circuit 12 then may flow through the tip axial cooling channel 34 and into the penultimate cavity 30 of the trailing edge circuit 14, merging with the cooling air 50 moving from the third to last cavity 28 in the trailing edge circuit 14. A portion of the cooling air 50 may flow through the at least one crossover hole 40 into the trailing edge tip corner 42, and a portion of the cooling air 50 may flow through the rest of the penultimate cavity 30 into the last cavity 32 through the rest of the trailing edge circuit 14.

The cooling flow split between the leading edge circuit 12 and the trailing edge circuit 14 may be adjusted to achieve more uniform metal temperatures within the blade 10. The adjustment may be in the form of varying the thickness of the multiple channels, adjusting the length of the multiple channels, or the like. There may also be regenerative cooling for the platform 66 through the cooling circuits by routing some of the cooling air from the serpentine cooling circuit to the platform 66 cooling and then returning to the serpentine cooling circuit.

In certain embodiments, the trailing edge circuit 14 may have a smaller radial length than the prior art in order to position the tip axial cooling channel 34 above the trailing edge circuit 14.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

What is claimed is:

1. A turbine rotor blade comprising:

a leading edge and a trailing edge joined by a pressure side and a suction side, a tip end, and a root end;

at least two cooling circuits formed within the blade to provide cooling for the blade comprising;

a leading edge circuit comprising a first cavity located along the leading edge of the blade and a second cavity positioned aft of the first cavity in an axial direction, wherein the leading edge circuit only flows forward so that the second cavity impinges forward directly into the first cavity;

a trailing edge circuit comprising at least a third cavity located in a mid-chord area of the blade aft of the second cavity, wherein the trailing edge circuit flows aft with at least two substantially 180-degree turns at the tip end and the root end of the blade providing at least a penultimate cavity and a last cavity, wherein the last cavity is located along a trailing edge of the blade; and a tip axial cooling channel comprising a first opening and a second opening, wherein the first opening connects to the first cavity and the second opening connects to the penultimate cavity, wherein the tip axial cooling channel connects the leading edge circuit to the trailing edge circuit, wherein the at least two cooling circuits are integrated only through the first opening and the second opening of the tip axial cooling channel connection; and at least one crossover hole connecting the penultimate cavity to the last cavity substantially near the tip end of the blade.

2. The turbine rotor blade according to claim 1, wherein the last cavity further comprises a plurality of trailing edge pins and/or a plurality of trailing edge exit holes along the trailing edge of the blade.

3. The turbine rotor blade according to claim 2, wherein each of the plurality of trailing edge pins comprises an airfoil shape.

4. The turbine rotor blade according to claim 1, further comprises an inboard squealer tip along the tip end of the blade.

5. The turbine rotor blade according to claim 1, further comprises broken offset turbulators along the last cavity and broken staggered turbulators along cavities forward of the last cavity.

6. The turbine rotor blade according to claim 1, further comprising a plurality of helical mini-grooves along the leading edge of the blade.

7. The turbine rotor blade according to claim 1, wherein the trailing edge circuit is a 3-pass serpentine cooling circuit.

8. The turbine rotor blade according to claim 1, wherein the trailing edge circuit is a 5-pass serpentine cooling circuit.

9. The turbine rotor blade according to claim 1, wherein the trailing edge circuit is a 7-pass serpentine cooling circuit.

10. A method for increasing cooling to a trailing edge tip corner of a turbine blade, comprising:

providing a tip axial cooling channel comprising a first opening and a second opening);

connecting the first opening of the tip axial cooling channel to an end of a first cavity of a leading edge circuit of at least two cooling circuits formed within the turbine blade, wherein the leading edge circuit comprises a first cavity located along a leading edge of the blade and a second cavity positioned aft of the first cavity in an axial direction, wherein the leading edge circuit only flows forward so that the second cavity impinges forward directly into the first cavity;

connecting the second opening of the tip axial cooling channel to a trailing edge circuit, wherein the trailing edge circuit comprises at least a third cavity located in a mid-chord area of the blade aft of the second cavity, wherein the trailing edge circuit flows aft with at least two substantially 180-degree turns at the tip end and the root end of the blade providing at least a penultimate cavity and a last cavity, wherein the last cavity is located along a trailing edge of the blade, wherein the at least two integrated cooling circuits further comprise at least one crossover hole connecting the penultimate cavity to the last cavity substantially near the tip end of the blade, wherein the at least two cooling circuits are integrated only through the first opening and the second opening of the tip axial cooling channel connection;

sending cooling air through the second cavity of the leading edge circuit and the third cavity of the trailing edge circuit, wherein the cooling air flowing through the leading edge circuit then flows through the tip axial cooling channel and into the penultimate cavity of the trailing edge circuit, merging with the cooling air entering into the penultimate cavity in the trailing edge circuit, wherein a portion of the cooling air flows through the at least one crossover hole into the trailing edge tip corner, and a portion of the cooling air flows through the rest of the penultimate cavity into and up through the last cavity through the rest of the trailing edge circuit into the trailing edge tip corner and/or out through the trailing edge of the turbine blade.

11. The method according to claim 10, further comprising introducing refresher air into the last cavity along the root end of the blade.

12. The method according to claim 10, wherein the last cavity further comprises a plurality of trailing edge pins and/or a plurality of trailing edge exit holes along the trailing edge of the blade.

13. The method according to claim 12, wherein each of the plurality of trailing edge pins comprise an airfoil shape.

14. The method according to claim 10, further comprises an inboard squealer tip along the tip end of the blade.

15. The method according to claim 10, further comprises broken offset turbulators along the last cavity and broken staggered turbulators along cavities forward of the last cavity.

16. The method according to claim 10, further comprising a plurality of helical mini-grooves along the leading edge of the blade.

17. The method according to claim 10, wherein the trailing edge circuit is a 3-pass serpentine cooling circuit.

18. The method according to claim 10, wherein the trailing edge circuit is a 5-pass serpentine cooling circuit.

19. The method according to claim 10, wherein the trailing edge circuit is a 7-pass serpentine cooing circuit.

* * * * *